US005294957A

United States Patent [19]

Ahn

[11] Patent Number: 5,294,957

[45] Date of Patent: Mar. 15, 1994

[54] DRIVE MEANS OF AN ELECTRO-PHOTOGRAPHY PROCESS UNIT

[75] Inventor: Byung-Seon Ahn, Suwon, Rep. of Korea

[73] Assignee: Samsung Electronics Co, Ltd.

[21] Appl. No.: 975,725

[22] Filed: Nov. 13, 1992

[30] Foreign Application Priority Data

Nov. 26, 1991 [KR] Rep. of Korea ..... 1991-21267

[51] Int. Cl.[5] ..... G03G 15/00; G03G 21/00

[52] U.S. Cl. ..... 355/200; 355/213; 355/251

[58] Field of Search ..... 355/200, 211, 212, 213, 355/245, 251, 253

[56] References Cited

U.S. PATENT DOCUMENTS 4,721,982 1/1988 Ueda ..... 355/253 X
5,028,966 7/1991 Kozuka et al. ..... 355/211 X
5,182,584 1/1993 Fukunaga et al. ..... 355/245 X

FOREIGN PATENT DOCUMENTS 61-156161 7/1986 Japan .
62-209469 9/1987 Japan .
4-24663(A) 1/1992 Japan .

*Primary Examiner*—Fred L. Braun

[57] ABSTRACT

A drive system for an electro-photography process unit including a first idle consisting of two gears coaxially arranged with a space for transmitting the power of a motor to a drum drive gear mounted on a shaft of a photo-sensitive drum and to a second idle gear with a different pitch for transmitting the power to a developer, the developer being arranged on one side of the drum, a magnet roll provided in the developer for transferring a toner to the drum, a first speedup gear with a different pitch engaged with the second idle gear for driving the magnet roll, and a second speedup gear with a different pitch engaged with the first speedup gear and with a gear of the magnet roll.

6 Claims, 4 Drawing Sheets

DRIVE MEANS OF AN ELECTRO-PHOTOGRAPHY PROCESS UNIT

TECHNICAL BACKGROUND

The present invention relates to a drive means of an electro-photography process unit.

Referring to FIG. 1 for illustrating a conventional electro-photography process unit, the surface of a photo-sensitive drum 28 is uniformly charged with a constant voltage by an electric charger 25 and then exposed to the light of a lamp 24 reflected from an original document placed on a platen glass 21, so that an electrostatic latent image is formed on the photo-sensitive drum 28 corresponding to the image of the document. The light source may be a laser scanning unit, light emitting diode, etc. Thereafter, as the photo-sensitive drum 28 is rotated, the toner of a developer 27 is attracted to the surface of the photo-sensitive drum 28 so as to develop the latent image transferred by a transfer means 32 to a sheet of paper supplied by a supply roll 20.

The paper adhering to the photo-sensitive drum 28 by the electrostatic force is separated by a separator 33 therefrom. Then the paper is conveyed by a conveyor belt 30 to a fixing means 40, where the paper is heated and pressed between a heat roll 34 and pressure roll 35 to fix the toner, conveyed to a discharging tray 39.

The residual toner on the photo-sensitive drum 28 is removed by a cleaning blade 29 and the latent image is canceled by the light supplied from a pre-erase lamp array 37.

FIG. 2 reveals the photo-sensitive drum 28 and magnet roll 27*b* which are driven by drive means as shown in FIGS. 3A and 3B. A motor has a shaft provided with a gear 22 and pulley 22*a*. The gear 22 is to transmit the power of the motor via a train of gears 41, 42 and 43 to a drum gear 28*a*. Meanwhile, the power of the motor is also transmitted via a pulley 22*a*, timing belt 45, pulley 44, idle gear 43*a*, magnet roll drive gear 46 to the magnet roll 27.

Such conventional drive means is very complicated, requiring a large installing space and many parts, thus increasing the production cost.

SUMMARY OF THE INVENTION

It is an object of the present invention to simplify the structure of the part of the drive means of an electrophotography process unit for driving the magnet roll of the developer, thereby decreasing the volume as well as the production cost of the electrophotography process unit.

According to the present invention, there is provided a drive means of an electro-photography process unit comprising a first idle gear means consisting of two gears coaxially arranged with a space, for transmitting the power of a motor to a drum drive gear mounted on a shaft of a photo-sensitive drum and to a second idle gear means with a different pitch for transmitting the power to a developer, the developer being arranged on one side of the drum, a magnet roll provided in the developer for transferring toner to the drum, a first speedup gear with a different pitch engaged with the second idle gear means for driving the magnet roll, and a second speedup gear with a different pitch engaged with the first speedup gear and with a gear of the magnet roll.

The present invention will now be described more specifically with reference to the drawings attached only by way of example.

BRIEF DESCRIPTION OF ATTACHED DRAWINGS

DETAILED DESCRIPTION OF A CERTAIN PREFERRED EMBODIMENT

Figure 1:
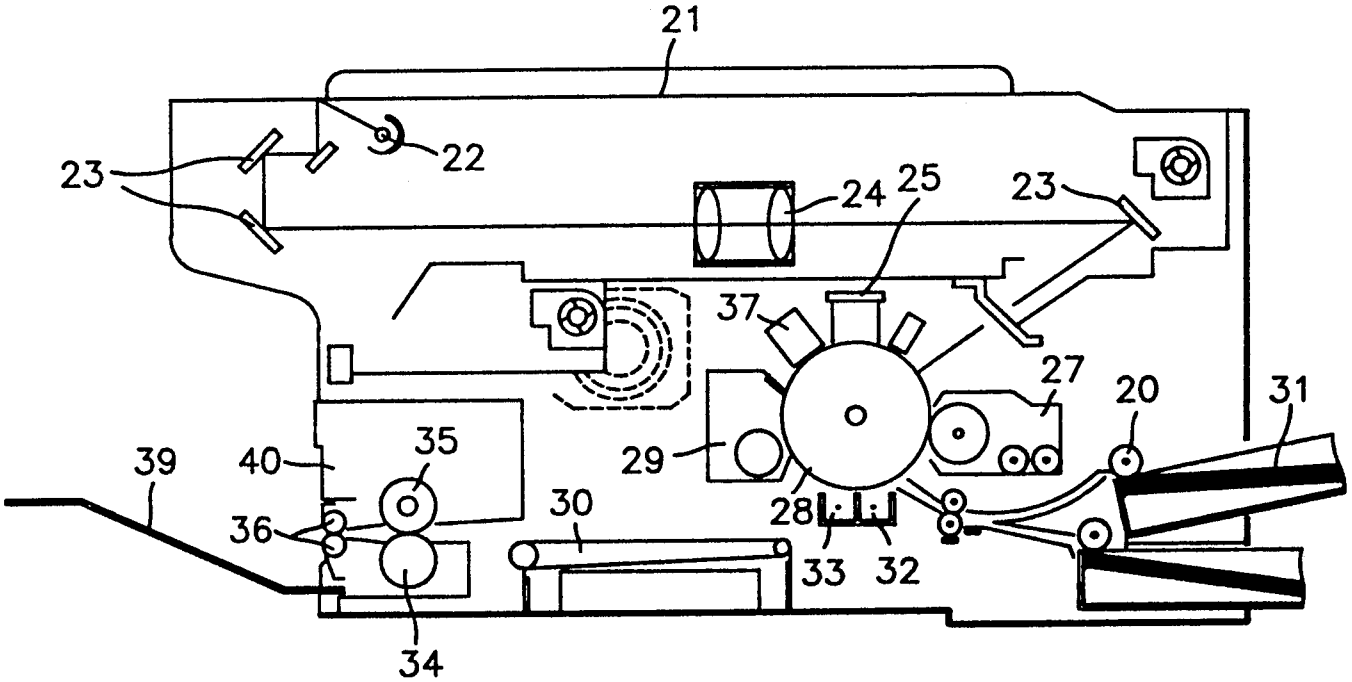
(PRIOR ART) FIG. 1
FIG. 1 is a schematic diagram for illustrating the structure of a conventional electro-photography process unit.
Figure 2:
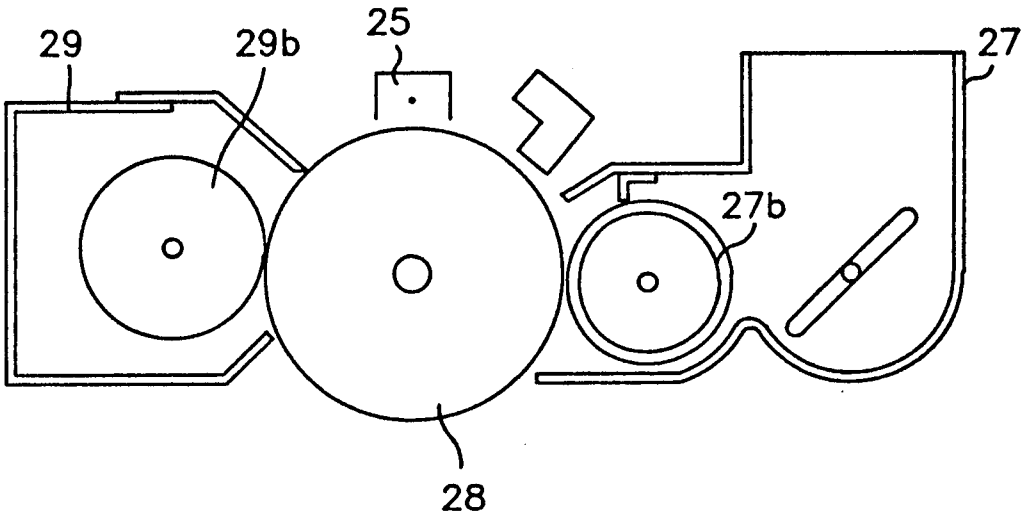
(PRIOR ART) FIG. 2
FIG. 2 is an enlarged side view of a part of FIG. 1.
Figure 3A:
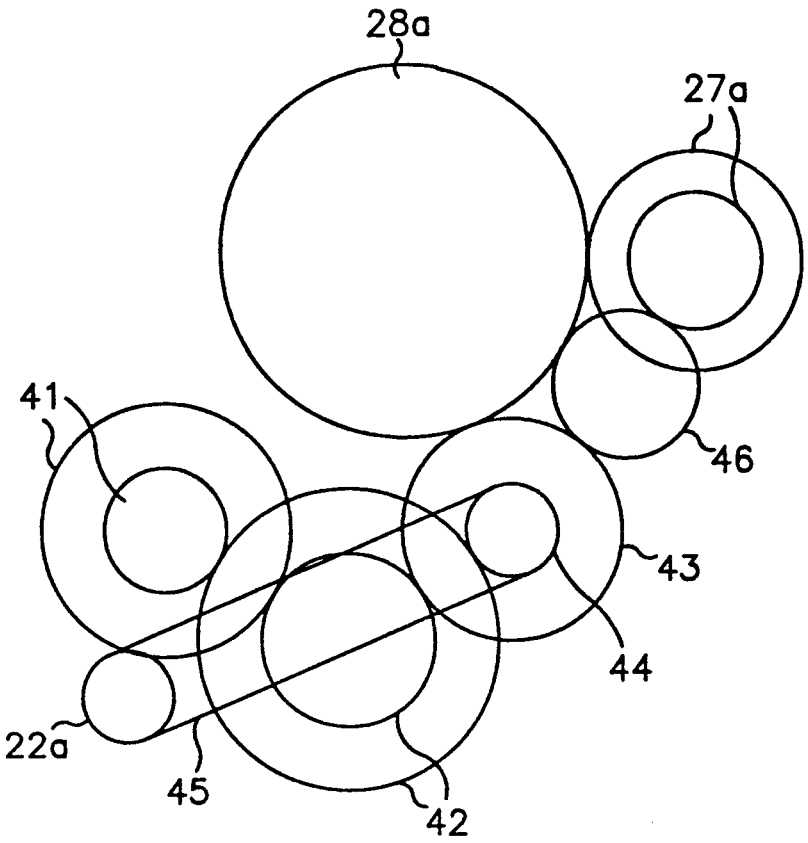
(PRIOR ART) FIG. 3A
FIG. 3A is a schematic view of a conventional drive means.
Figure 3B:
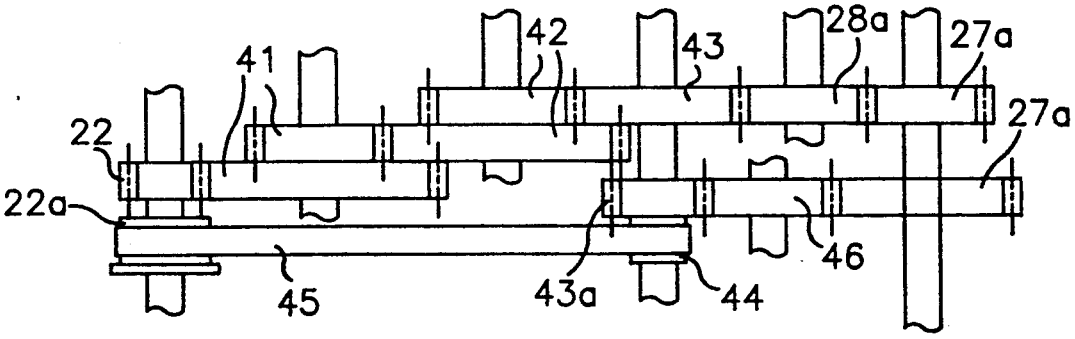
(PRIOR ART) FIG. 3B
FIG. 3B is a side view of FIG. 3A.
Figure 4A:
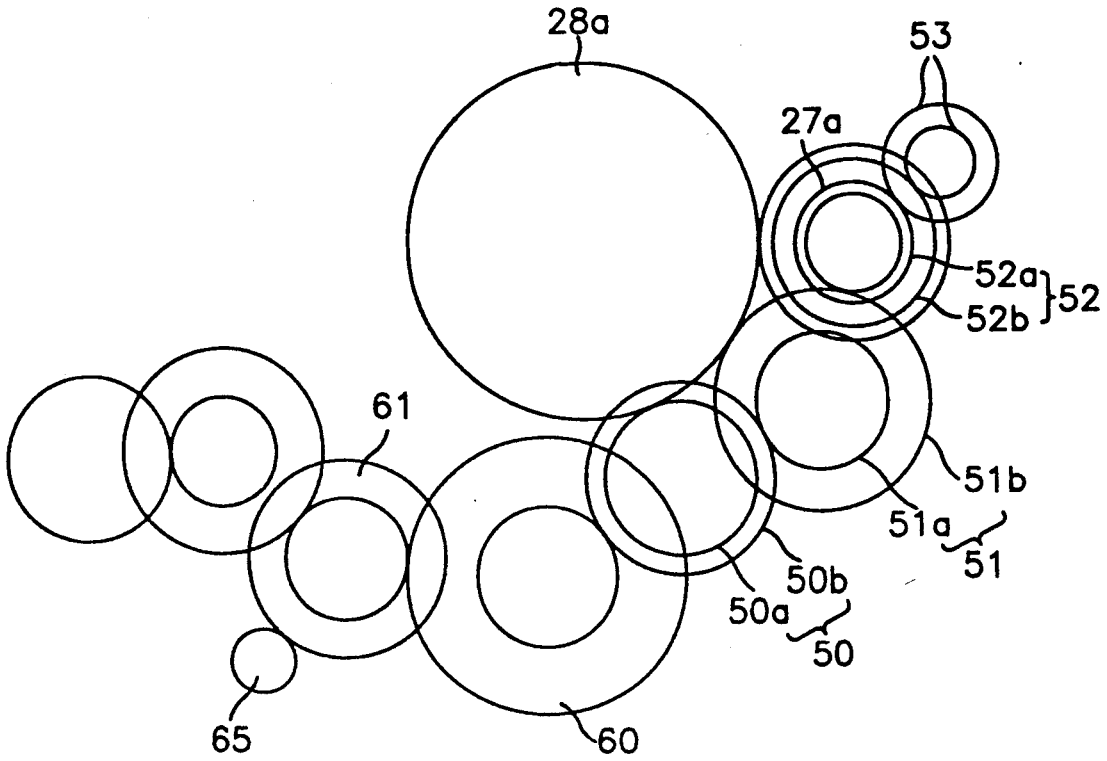
FIG. 4A is a view similar to FIG. 3A but according to the present invention.
Figure 4B:
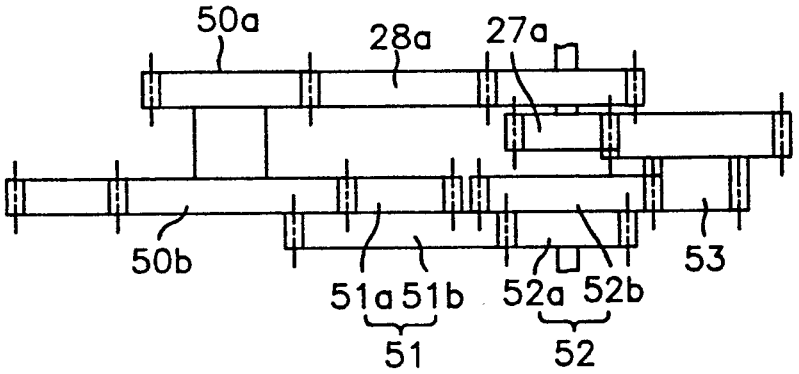
FIG. 4B is a side view of FIG. 4A.

Referring to FIGS. 4A and 4B, a first idle gear means 50 consists of two gears 50*a* and 50*b* of different sizes coaxially arranged with a space. The smaller gear 50*a* is engaged with a drum drive gear 28*a* mounted on the rotational shaft of the photo-sensitive drum 28. The larger gear 50*b* is to transmit the power of a motor to the developer 27. A second idle gear means 51 consists of a smaller gear 51*a* and larger gear 51*b*. The smaller gear 51*a* is engaged with the larger gear 50*b* of the first idle gear means 50, and the larger gear 51*b* with a first speedup gear 52, which in turn is engaged with a second speedup gear 53 of a different pitch engaged with a magnet roll gear 27*a* mounted on the shaft of the magnet roll.

In operation, the photo-sensitive drum 28 charged by the electric charger 25 is rotated by means of the drum drive gear 28*a*. Namely the rotational motion of the motor is transmitted via the idle gears 61, 60 to the idle gears 50*a*, 50*b*, so that the drum drive gear 28*a* engaged with the idle gear 50*a* is rotated. Meanwhile the rotational motion of the idle gears 50*a*, 50*b* is transmitted via the idle gear means 51 to the developer 27.

Thus the first speedup gear 52 drives the second speedup gear 53 provided in the developer 27. The second speedup gear 53 in turn drives the magnet roll gear 27*a* of the magnet roll.

What is claimed is:

1. A drive apparatus of an electro-photography process unit comprising:

first idle gear means comprising two gears coaxially arranged and spaced apart from each other, for transmitting the power of a motor to a drum drive gear mounted on a shaft of a photo-sensitive drum and to a second idle gear means with a different pitch for transmitting said power to a developer, said developer being arranged on one side of said drum;

a magnet roll provided in said developer for transferring a toner to said drum;

a first speedup gear with a different pitch engaged with said second idle gear means for driving said magnet roll; and a second speedup gear with a different pitch engaged with said first speedup gear and with a gear of said magnet roll.

2. A drive apparatus of an electro-photography process unit having a photo-sensitive drum, comprising:

a drum drive gear mounted on a rotational shaft of said photo-sensitive drum, for driving said photo-sensitive drum;

a magnet roll having a magnetic roll gear and located in a developer, for transferring toner to said photo-sensitive drum;

a motor for providing rotary power;

means for transferring said rotary power of said motor;

first idle gear means for receiving said rotary power from said transfer means, said first idle gear means having a first idle gear engaged with said transfer means and a second idle gear coaxial with and spaced apart from said first idle gear, said second idle gear rotating in a same rotational direction as said first idle gear when said first gear is rotated by said transfer means, said second idle gear engaging said drum drive gear to rotate said drum drive gear;

second idle gear means for engaging said first idle gear of said first idle gear means, and rotating in response to rotation of said first idle gear;

first speed up gear means for engaging said second idle gear means, and rotating in response to said rotation of said second idle gear means; and second speed up gear means for engaging said first speed up gear means and said magnet roll gear, and for rotating said magnet roll gear in response to said rotation of said first speed up gear means.

3. The drive apparatus as claimed in claim 2, wherein:

said second idle gear means comprises:

a third idle gear engaging said first idle gear; and a fourth idle gear having a different diameter than said third idle gear and coaxial with said third idle gear, said fourth idle gear rotating when said third idle gear is rotated by said first idle gear;

said first speed up gear means comprises:

a first speed up gear engaging said fourth idle gear; and

A second speed up gear having a different diameter than said first speed up gear and coaxial with said first speed up gear, said second speed up gear rotating when said first speed up gear is rotated by said fourth idle gear; and said second speed up gear comprises:

a third speed up gear engaging said second speed up gear; and a fourth speed up gear having a different diameter than said third speed up gear and coaxial with said third speed up gear, said fourth speed up gear engaging said magnet roll gear, wherein said fourth speed up gear rotates said magnet roll gear when said third speed up gear is rotated by said second speed up gear.

4. The drive apparatus as claimed in claim 3, wherein:

said first idle gear has a larger diameter than said second idle gear;

said fourth idle gear has a larger diameter than said third idle gear;

said second speed up gear has a larger diameter than said first speed up gear; and said fourth speed up gear has a larger diameter than said third speed up gear.

5. A drive apparatus of an electro-photography process unit having a photo-sensitive drum, comprising:

a drum drive gear mounted on a rotational shaft of said photo-sensitive drum, for driving said photo-sensitive drum;

a magnet roll having a magnetic roll gear and located in a developer, for transferring toner to said photo-sensitive drum;

a motor for providing rotary power;

means for transferring said rotary power;

first idle gear means for receiving said rotary power from said transfer means, said first idle gear means having a first idle gear engaged with said transfer means and a second idle gear coaxial with and spaced apart from said first idle gear, said second idle gear rotating in a same first rotational direction as said first idle gear when said first gear is rotated by said transfer means, said second idle gear engaging said drum drive gear to rotate said drum drive gear;

second idle gear means for receiving rotary power of said first idle gear, said second idle gear means having a third idle gear engaging said first idle gear and a fourth idle gear coaxial with said third idle gear and rotating in a same second rotational direction as said third idle gear when said third idle gear is rotated;

first speed up gear means for receiving rotary power of said fourth idle gear, said speed up gear means having a first speed up gear engaging said fourth idle gear and a second speed up gear coaxial with said first speed up gear and rotating in a same third rotation direction as said first speed up gear when said first speed up gear is rotated by said fourth idle gear; and second speed up gear means for receiving rotary power of said second speed up gear, said second speed up gear means having a third speed up gear engaging said second speed up gear and a fourth speed up gear coaxial with said third speed up gear, said fourth speed up gear engaging said magnet roll gear and rotating said magnet roll gear and said magnet roll when said third speed up gear is rotated by said second speed up gear.

6. The drive apparatus as claimed in claim 5, wherein:

said first idle gear has a larger diameter than said second idle gear;

said fourth idle gear has a larger diameter than said third idle gear;

said second speed up gear has a larger diameter than said first speed up gear; and said fourth speed up gear has a larger diameter than said third speed up gear.

* * * * *

UNITED STATES PATENT AND TRADEMARK OFFICE

CERTIFICATE OF CORRECTION

PATENT NO. : 5,294,957
DATED : 15 March 1994
INVENTOR(S) : Byung-Seon Ahn

It is certified that error appears in the above-indentified patent and that said Letters Patent is hereby corrected as shown below:

On the title page, Item [56]: under Foreign Patent Documents below "*Primary Examiner* - Fred L. Braun", insert --*Attorney, Agent, or Firm* - Robert E. Bushnell--.

IN THE CLAIMS

Column 3,

Line 39, change "A second" to --a second--.

Signed and Sealed this

Sixth Day of September, 1994

*Attest:*

*Attesting Officer*

BRUCE LEHMAN

*Commissioner of Patents and Trademarks*